United States Patent [19]

Felker et al.

[11] 4,063,715

[45] Dec. 20, 1977

[54] MATERIAL MIXER-TRITURATOR

[76] Inventors: Paul J. Felker, 300 Columbus Drive; Shubel H. Owen, Rte. 4, Box 238, both of Marshfield, Wis. 54449

[21] Appl. No.: 720,189

[22] Filed: Sept. 3, 1976

[51] Int. Cl.[2] ..... B01F 9/10; B01F 15/02

[52] U.S. Cl. ..... 366/187; 233/3; 366/192; 366/231

[58] Field of Search ..... 259/3, 14, 15, 16, 30, 259/31, 32, 33, 57, 58, 81 R, 89, 90, 8; 233/3

[56] References Cited

U.S. PATENT DOCUMENTS

| | | | |
|---|---|---|---|
| 2,896,556 | 7/1959 | Sippel | 259/15 |
| 3,434,697 | 3/1969 | Carlson | 259/3 |
| 3,531,092 | 9/1970 | Praschak | 259/8 |

*Primary Examiner*—Robert W. Jenkins

*Attorney, Agent, or Firm*—Wheeler, Morsell, House & Fuller

[57] ABSTRACT

A bowl having a bottom discharge opening is mounted at its periphery on a frame for rotation about an upright axis. A discharge gate is mounted on the frame under the bowl for movement along the bowl axis to control the discharge opening. A top inlet opening directs material to be processed onto the discharge gate. This material is propelled in a straight line radially up the inner wall of the rotating bowl by centrifugal force between radial vanes. Stationary guide vanes are suspended within the interior of the bowl to intercept the material at the upper margin of the bowl and direct the material in streams which collide in the center of the bowl to mix and/or triturate the material. Turning vanes or discharge cups are mounted for movement into registration with the guide vanes to direct the streams toward the discharge opening when the discharge gate is open.

14 Claims, 4 Drawing Figures

MATERIAL MIXER-TRITURATOR

BACKGROUND OF THE INVENTION

This invention relates to rotary material processing devices in which material to be processed is set in motion by a rotary element and is so guided as to form a plurality of streams that are directed toward each other so as to collide and cause the material in the streams to intermingle and interact to process the material. A typical example of this type of device is disclosed in U.S. Pat. No. 3,531,092. The processing device disclosed in Pat. No. 3,531,092 includes a fixed hollow mixing bowl which has a rotary impeller with spiral vanes in the interior of its lower shell portion and has a set of guide vanes in the interior of its upper shell portion. At the end of a predetermined processing interval, the rotary impeller must be slowed down and a discharge opening in a side of the lower shell portion opened to allow discharge of the processed material.

The above-described processing device performs its intended function, but it has several serious shortcomings. One major problem involves the seal and bearing for the impeller. The material to be processed often includes hard granular particles, e.g. the sand in concrete mix, and these particles work their way into the impeller seal and bearing and cause them to fail prematurely. In their original state, the sand particles may in some instances be too large to penetrate the impeller seal, but they are reduced in size by collision with other sand particles in the colliding streams until they are small enough to penetrate the seal and bearing and cause them to fail.

Another problem is that it is necessary to slow the rotary impeller down to permit discharge of the processed material, which discharge takes a relatively long time.

A further problem is that foreign material such as scrap iron in the material being processed may jam or break the rotary impeller.

SUMMARY OF THE INVENTION

In accordance with this invention, the foregoing problems have been solved by providing, instead of a fixed bowl, a rotatable bowl which is mounted on its periphery for rotation about an upright axis, with a discharge opening in the bottom of the bowl and a movable discharge gate closing the discharge opening, and stationary guide vanes suspended within the top of the rotatable bowl to intercept the material from the rotating inner wall of the bowl and direct it in streams which collide in the center of the bowl to mix and/or triturate the material. In the preferred embodiment, turning vanes are shiftably mounted adjacent the inner ends of the guide vanes to deflect the streams of material toward the discharge opening when the latter is open.

In the present invention the bearing is on the outer periphery of the bowl, and it is an object of the present invention to thus eliminate the possibility of the bearing being injured by material within the bowl. Also, foreign material within the bowl cannot jam or break the impeller, since the rotary bowl itself serves as the impeller and thus eliminates the need for a separate impeller.

A further object of the invention is to provide a construction which permits the processed material to be discharged through a relatively large bottom opening while the bowl is rotating at full speed, to substantially lessen the discharge time.

A further object of the invention is to provide a construction in which the support for rotation of the bowl is above the bowl's center of gravity, to thus provide a more stable rotating member. In addition, the drive means for a single speed rotating device is much simpler and less expensive than the drive means for the impellers of the prior art.

Other objects and advantages of the invention will be apparent from the detailed description of the invention.

DETAILED DESCRIPTION OF THE INVENTION

Figure 1:
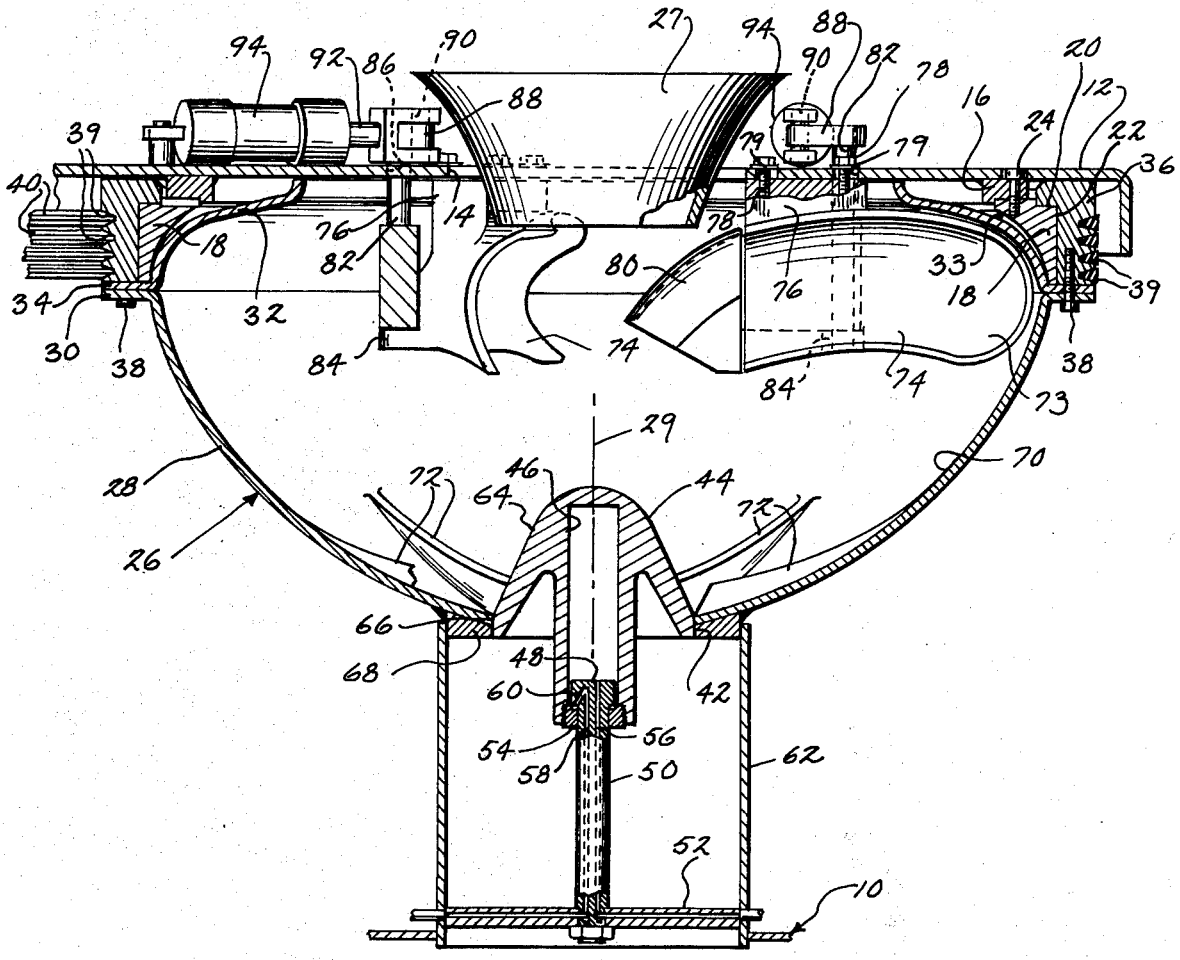
FIG. 1 is an axial sectional view of one embodiment of the invention.

The disclosed embodiment includes a frame 10 having a top plate 12 with a circular opening 14 therein. A spacing ring 16 is welded to the bottom of top plate 12 in coaxial relationship with opening 14. A bearing ring 18 having a flat annular horizontal bearing surface 20 and an annular vertical bearing surface 22 is attached to the bottom of spacing ring 16 by bolts 24.

A metal bowl 26 comprises a lower portion 28 having a flanged rim 30 and an upper portion 32 having a flanged rim 34. The bowl is journalled to bearing ring 18 by means of a journal ring 36 which is shaped to engage both bearing surfaces 20 and 22 of bearing ring 18. Ring 36 is attached to flanged rims 30 and 34 by bolts 38. Journal ring 36 has grooves 39 on its outer periphery to form a pulley arrangement for receiving V-belts 40 which are suitably driven through transmission means connected with a suitable motor. The annular space 33 between bearing ring 18 and upper bowl portion 32 acts as a lubrication well for bearing surfaces 20 and 22.

Although bowl 26 is rotatably attached to frame 10 by the bearing illustrated, it should be understood that a roller bearing could also be used and might be preferable in certain embodiments. The important feature is that the bearing is located at the outer periphery of bowl 26 so that it will not be subjected to damage from particulate material being processed within bowl 26. It is also desirable that the bearing be located above the center of gravity of bowl 26 to provide greater stability during rotation.

A discharge opening 42 of relatively large size is formed in the bottom portion 28 of bowl 26, and a discharge gate 44 is movably supported on frame 10 below bowl 26 along the axis 29 thereof to close discharge opening 42. Gate 44 has a cylindrical bore 46 coaxial with bowl axis 29. The gate is both slideably and rotatably mounted relative to a fixed piston 48 which is supported by a piston rod 50, the latter being supported by a cross-brace 52. The lower end of bore 46 is closed by a gland nut 54. Ducts 56, 58, and 60 are drilled in piston 48 and piston rod 50 to enable hydraulic fluid under pressure to be circulated to raise and lower gate 44. When hydraulic fluid is forced into duct 56 and out of duct 58 by conventional hydraulic pump and control means (not shown), gate 44 rises until it reaches the closing position shown in FIG. 1. When the hydraulic pressure is reversed, gate 44 is lowered, thus allowing the full flow of material from the discharge cups 80 to be discharged into discharge spout 62, the latter being mounted on the frame 10 below bowl 26.

Gate 44 has a sloping outer surface 64 and a tapered peripheral edge 66, the latter seating against the margin of discharge opening 42, which margin may be strengthened by a ring 68 welded to bottom bowl portion 28. Peripheral edge 66 seals discharge opening 42 and causes gate 44 to rotate with bowl 26 when it is in the upper closed position shown in FIG. 1.

Material which is fed into the open top of bowl 26 through a fill cone 27 falls on tapered surface 64 and slides down to the periphery of discharge opening 42 where there is sufficient centrifugal force, when bowl 26 is rotating at full speed, to cause the material to travel upwardly in radial streams along the inner wall 70 of lower bowl portion 28. Radial ribs 72 are preferably formed on bowl wall 70 to prevent circumferential movement of the material relative to the bowl and direct it along radial lines. This reduces the wear on bowl 26 and provides a more efficient transfer of energy from the bowl to the material, thereby using a minimum of power.

Figure 3:
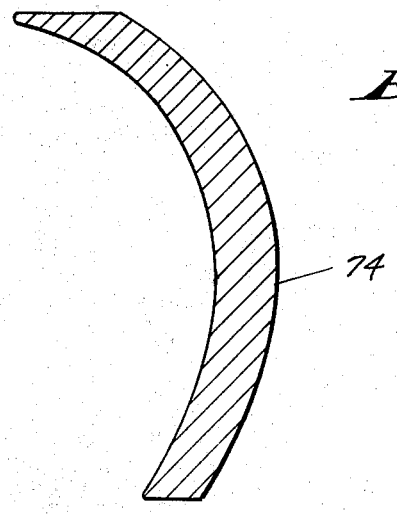
FIG. 3 is a fragmentary cross-sectional view taken on the line 3—3 of FIG. 2.
Figure 2:
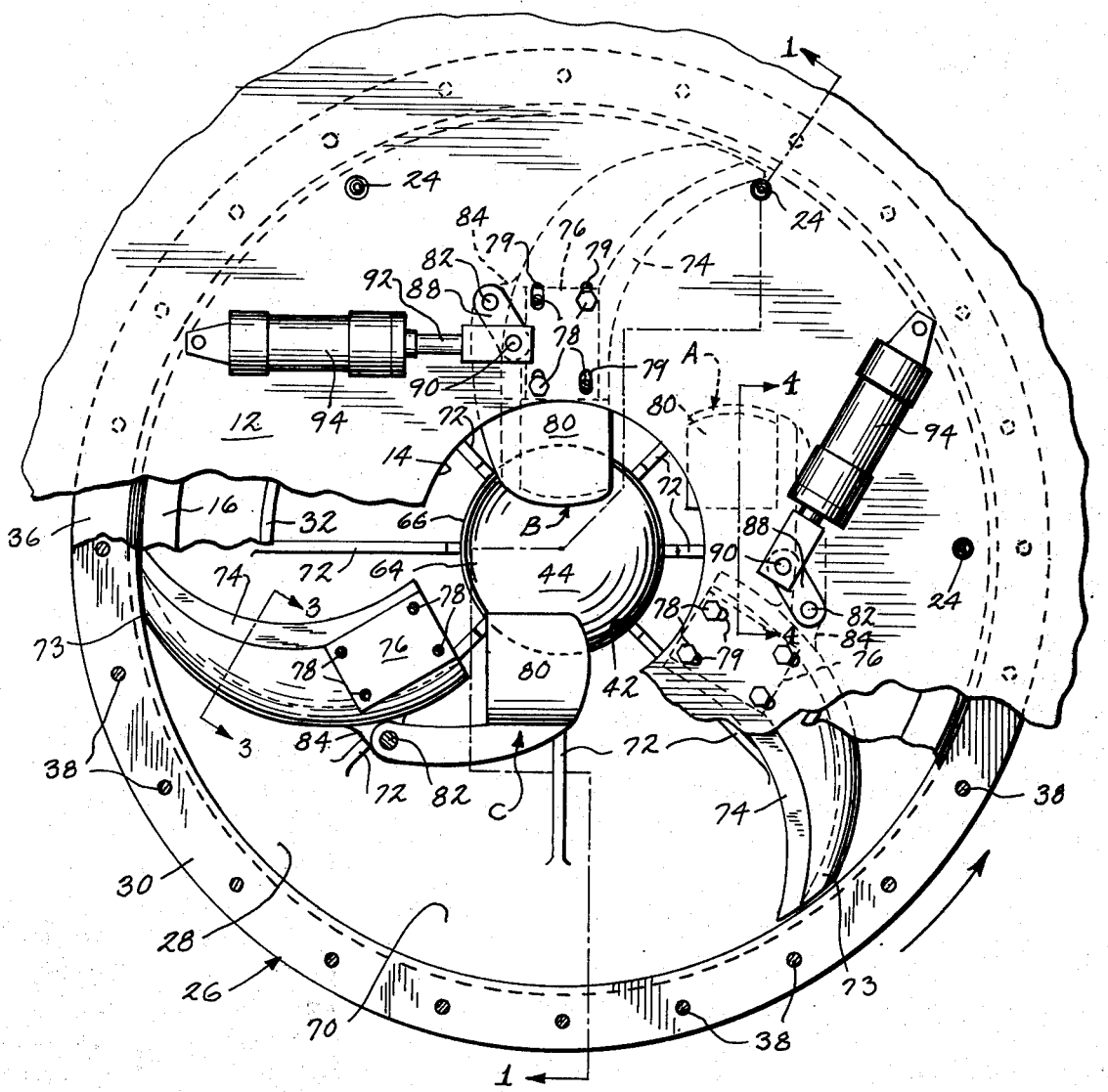
FIG. 2 is a plan view looking at the top of the upper shell, part of the shell being broken away and the support for rotation being omitted.

After the material has moved radially upwardly on the inner wall 70 of lower bowl portion 28, it is intercepted by the curved outer ends 73 of stationary guide vanes 74 which have the cross-sectional shape shown in FIG. 3. These vanes are suspended within the upper portion of bowl 26 by support brackets 76 that are attached to top plate 12 by bolts 78 which pass through slotted openings 79 in the top plate 12 so as to permit adjustment of the position. Guide vanes 74 are shaped to intercept the material and guide it in streams which are directed inwardly toward the center of bowl 26. To perform this function, guide vanes 74 are curved both in cross-section, as shown in FIG. 3, and in plan view, as shown in FIG. 2.

In plan view, the outer ends of guide vanes 74 are approximately tangent to the inner periphery of bowl 26, and the vanes then curve inwardly toward the center of the bowl to direct the streams of material toward each other so that they collide in the center of bowl 26, thereby causing the particles which make up the streams to mix and/or triturate to process the material.

The processed material is directed downwardly on top of the gate 44, is then urged by gravity to the bottom bowl portion 28, and the cycle is then repeated. This continuous recirculation and processing of the material proceeds for a predetermined processing time, depending upon the particular type of material and the type of processing desired.

To discharge the processed material out of bowl 26, gate 44 is hydraulically lowered, as described previously, and discharge cups 80 are swung into registration with the inner ends of guide vanes 74 to direct the material streams toward discharge opening 42. With the construction of the present invention, the opening 42 may be large enough to accommodate the entire flow of the discharging material. This type of discharge can be carried out while bowl 26 is rotating at full speed, thus simplifying the discharge process and also speeding it up.

Figure 4:
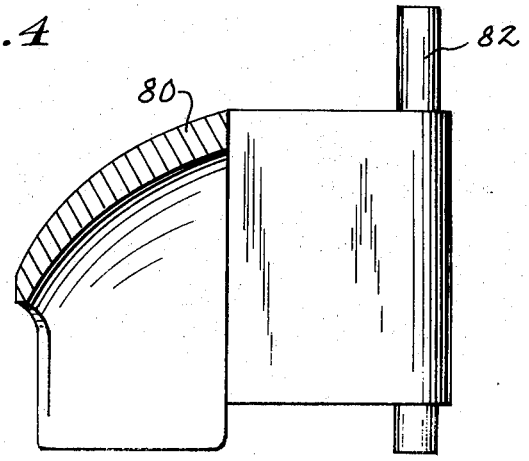
FIG. 4 is a fragmentary cross-sectional view taken on the line 4—4 of FIG. 2.

Discharge cups 80, when in discharge position, are curved downwardly as shown in FIG. 4. FIG. 1 only shows one of such cups, but it is understood that there is a cup for each vane 74, as shown in FIG. 2. Each cup is rigidly attached to a vertical supporting rod 82 (FIG. 2), the latter being rotatably supported at its lower end in an ear 84 projecting from the adjacent vane 74 and extending upwardly through a journal opening 86 (FIG. 1) in top plate 12. A crank arm 88 has one end connected to the rod 82 and has its other end pivotally connected as at 90 to the piston rod 92 of a fluid pressure operated cylinder 94. Each vane 74 has a like discharge cup arrangement.

The position of the various elements which support and move discharge cups 80 are illustrated in both their retracted and operative positions in FIG. 2, the right-hand assembly A being retracted, the upper assembly B being in operative position for discharge, and the left-hand assembly C being in an intermediate position. In the retracted position, discharge cups 80 are out of the stream of material issuing from the inner ends of vanes 74, and in the operative position, cups 80 are in a position to deflect the material downwardly directly toward discharge opening 42.

Although the deflector assemblies A, B, and C are shown in different positions in FIG. 2, for purposes of illustration, it should be understood that deflector assemblies A, B, and C are controlled from a common fluid pressure source and retract and extend simultaneously starting from the same position. Cups 80 are either all in the extended position B or all in the retracted position A at the same time, or are all moving simultaneously from one position to the other. When the cups are retracted, the three streams issuing from guide vanes 74 will collide to mix and/or triturate the material.

Various changes and modifications may be made without departing from the spirit of the invention, and all of such changes are contemplated as may come within the scope of the claims.

What we claim is:

1. A material processing device comprising a frame, a bowl mounted on said frame for rotation about an upright axis, said bowl having an inlet opening, means for rotating said bowl, said bowl having an internal wall which is so shaped that when the bowl is rotated centrifugal guide vanes suspended in fixed position from said frame portion within an upper portion of said bowl whereby the bowl is rotatable relative to said vanes, each guide vane having an inner discharge end and having an outer end shaped and positioned to intercept material which has been moved upwardly on the wall of the rotating bowl, and said guide vanes being shaped and positioned to direct streams of said material from their inner ends toward the center of the bowl where said streams may collide to cause one of mixing and trituration of the materials, and in which the bowl has a bottom discharge opening, a gate for said discharge opening, and in which there are deflector means for directing material from the streams at the center of the bowl downwardly toward said opening when said gate is open.

2. A material processing device as claimed in claim 1 wherein said deflector means for directing material from the streams at the center of the bowl downwardly toward said opening when said gate is open comprise discharge cups and means for supporting said discharge cups on said frame for swinging movement into and out of operative position adjacent the inner ends of said guide vanes and for directing the material downwardly toward said discharge opening.

3. A material processing device as claimed in claim 2 in which each discharge cup is rockably supported on the guide vane which it controls, and in which there is fluid pressure operated means on said frame for rocking said discharge cups to move the latter into and out of operative position with respect to the inner ends of said guide vanes.

4. A material processing device comprising a frame, a bowl mounted on said frame for rotation about an upright axis, said bowl having an inlet opening, means for rotating said bowl, said bowl having an internal wall which is so shaped that when the bowl is rotated centrifugal force will cause material to move upwardly on the wall, guide vanes suspended in fixed position from said frame portion within an upper portion of said bowl whereby the bowl is rotatable relative to said vanes, each guide vane having an inner discharge end and having an outer end shaped and positioned to intercept material which has been moved upwardly on the wall of the rotating bowl, and said guide vanes being shaped and positioned to direct streams of said material from their inner ends toward the center of the bowl where said streams may collide to cause one of mixing and trituration of the materials, and means for discharging the processed material from the bowl, and wherein said bowl has a bottom discharge opening, in which there is a discharge gate having an upwardly projecting portion, and means for supporting said gate for movement into and out of closing position with respect to said bowl and for rotation with said bowl when said bowl is rotating.

5. A material processing device as claimed in claim 4 wherein said means for supporting the discharge gate is mounted on said frame to afford upward and downward movement along the axis of said bowl and to afford rotation about said axis whereby the gate may rotate with the bowl.

6. A material processing device as claimed in claim 2 in which there is rotatable drive means on the outer periphery of said bearing ring.

7. A material processing device as claimed in claim 6 in which said rotatable drive means comprises at least one groove in the outer periphery of said bearing ring, and in which there is a drive belt engaged with said groove.

8. A material processing device as claimed in claim 4 wherein said discharge gate has a cylindrical center portion with a bore coaxial with the axis of said bowl, wherein there is a stationary piston within said bore, and wherein there is fluid pressure operated means communicating with said bore for causing said gate to move along the bowl axis into and out of closing position.

9. A material processing device comprising a frame, a bowl mounted on said frame for rotation about an upright axis, said bowl having an inlet opening, means for rotating said bowl, said bowl having an internal wall which is so shaped that when the bowl is rotated centrifugal force will cause material to move upwardly on the wall, guide vanes suspended in fixed position from said frame portion within an upper portion of said bowl whereby the bowl is rotatable relative to said vanes, each guide vane having an inner discharge end and having an outer end shaped and positioned to intercept material which has been moved upwardly on the wall of the rotating bowl, and said guide vanes being shaped and positioned to direct streams of said material from their inner ends toward the center of the bowl where said streams may collide to cause one of mixing and trituration of the materials, and means for discharging the processed material from the bowl, and wherein there is an annular bearing ring rigidly attached to the outer periphery of said bowl, and in which there is bearing means on said frame positioned to rotatably support said bearing ring whereby the bowl is rotatably suspended.

10. A material processing device as claimed in claim 9 in which said bearing ring is positioned above the center of gravity of said bowl.

11. A material processing device as claimed in claim 9 wherein each guide vane is curved in plan view, and wherein the outer portion of each vane is approximately tangent to the adjacent inner periphery of said bowl.

12. A material processing device as claimed in claim 9 wherein said bowl is dished to provide an upwardly curving lower side portion with a flanged rim, and wherein said bowl has a downwardly curving upper portion provided with a flanged rim, and wherein there is means joining said two rims together.

13. A material processing device as claimed in claim 12 wherein said bowl has an annular bearing ring rigidly attached to said flanged rim, and wherein there is bearing means mounted on the frame and positioned to rotatably support said bearing ring.

14. A material processing device as claimed in claim 13 wherein both said bearing means and bearing ring have matching vertical and horizontal bearing surfaces, and wherein there is a space between said upper bowl portion and said bearing means providing a lubrication well for lubricating said bearing surfaces.

* * * * *

UNITED STATES PATENT AND TRADEMARK OFFICE

CERTIFICATE OF CORRECTION

PATENT NO. : 4,063,715

DATED : December 20, 1977

INVENTOR(S) : Paul J. Felker and Shubel H. Owen

It is certified that error appears in the above-identified patent and that said Letters Patent are hereby corrected as shown below:

In column 4, Claim 1, lines 5 and 6, after "centrifugal" the following phrase has been omitted and should be inserted:

---force will cause material to move upwardly on the wall,---

Signed and Sealed this

Thirtieth Day of May 1978

[SEAL]

Attest:

RUTH C. MASON
Attesting Officer

LUTRELLE F. PARKER
Acting Commissioner of Patents and Trademarks